United States Patent [19]

Brown

[11] Patent Number: 4,819,284

[45] Date of Patent: Apr. 11, 1989

[54] INFLATABLE CRIB

[76] Inventor: Kenneth A. Brown, P.O. Box 149, Weatogue, Conn. 06089

[21] Appl. No.: 134,855

[22] Filed: Dec. 18, 1987

[51] Int. Cl.[4] ..... A47D 7/00

[52] U.S. Cl. ..... 5/98 R; 5/99 R; 5/99 A

[58] Field of Search ..... 5/93 R, 94, 98 R–99 C, 5/449, 455, 458

[56] References Cited

U.S. PATENT DOCUMENTS

| | | | |
|---|---|---|---|
| 2,287,907 | 6/1942 | Schettler, Jr. | 5/98 R |
| 2,617,999 | 11/1952 | Mitchell | 5/99 A |
| 3,049,728 | 8/1962 | Lund | 5/99 R |
| 3,819,825 | 11/1971 | Taub et al. | 5/94 |
| 4,056,858 | 11/1977 | Weber | 5/458 X |
| 4,104,750 | 8/1978 | Kelter et al. | 5/93 R |
| 4,172,301 | 10/1979 | Everard et al. | 5/455 X |

*Primary Examiner*—Gary L. Smith
*Assistant Examiner*—Michael F. Trettel
*Attorney, Agent, or Firm*—Bachman & LaPointe

[57] ABSTRACT

The present invention relates to an inflatable crib formed by an inflatable base portion, a plurality of independently inflatable sidewalls, and a screen-like webbing connecting each sidewall to the base portion. The crib further includes a support frame and a sleeve attached to each sidewall for receiving a component of the frame.

10 Claims, 2 Drawing Sheets

INFLATABLE CRIB

BACKGROUND OF THE INVENTION

The present invention relates to a portable inflatable infant enclosure, in particular an inflatable crib.

Different types of portable cribs and bassinets are known and available in the market place. Many of these structures however suffer from disadvantages such as being potentially unsafe and being relatively heavy, bulky, and difficult to handle even when in a folded or collapsed condition. Most of these disadvantages stem from the rigid members used to support the structure in an erect condition. Often, the rigid members are formed from heavy materials and have sharp edges which pose a hazard to a child/infant within the portable structure as well as to those assembling or handling the structure. One solution to these problems has been to provide a portable enclosure which is at least partly formed by inflatable components.

U.S. Pat. No. 3,049,728 to Lund illustrates a collapsible crib having an inflatable floor section, inflatable end sections attached to the floor section, and non-inflatable side sections. The side sections are connected to the end sections by separable fasteners at each of the four corners so as to facilitate assembly and disassembly of the crib. Each side and end section is provided with a tubular sleeve for receiving the supporting rods of a rigid frame used to maintain the desired shape for the crib. The primary deficiency of this structure is the potentially dangerous situation created by the use of separable fasteners to join the side and end sections. If a child/infant within the crib were to unfasten a fastener or if one of the fasteners was defective, an opening could be created between the sections sufficient for the child/infant to crawl through or for the child/infant to insert a limb or its head. Since the crib is suspended by the frame, such an occurrence could be extremely dangerous.

U.S. Pat. No. 3,323,147 to Van Dean illustrates an inflatable bassinet comprising two sheets of non-porous, flexible material forming a base panel and four side panels. The sheets are secured together so as to define therebetween two closed, air-retaining chambers. In addition, temporary fasteners such as zippers, snaps, buttons or ties are used to join the side and end panels at right angles to the bottom panel. Hereagain, the use of temporary fasteners creates a potentially dangerous situation. Further, the valves for inflating and deflating the bassinet are located inside the bassinet within reach of an infant. Should the infant grab one of the air valves, the bassinet could quickly deflate, again creating a dangerous situation.

U.S. Pat. No. 3,430,271 to Junod-Deile describes a child's playpen having an inflatable lower tube, a non-inflatable bottom attached to the lower tube, an upper inflatable tube forming a rail, and a plurality of bars formed from a flexible material fixed to flexible tubes adapted to be fastened to the upper and lower inflatable tubes forming the sides of the playpen. The most serious disadvantage associated with this construction is the danger of an infant having its head caught between the flexible side bars.

U.S. Pat. No. 4,003,098 to Fink illustrates an inflatable crib for babies. The crib has a base section in the form of an air mattress and four upstanding sidewalls attached thereto and in air communication therewith. The base portion and the sidewalls are provided with heat sealed seams which terminate inwardly of the edges of the several portions of the crib structure. An intercommunicating means for inflation of the device or deflation thereof from a common passageway is provided and equipped with an air valve. The inflatable crib is supported by a rectangular multi-section frame having a plurality of telescopic legs. A plurality of straps with snap fasteners are attached to the upper edge of the crib's sides to be fastened about the frame so that the frame holds the sidewalls of the crib in an upstanding position in the event air is accidentally or deliberately lost from the inflated structure.

The Fink design while meeting the goals of being lightweight, readily portable and inexpensively formed suffers from several serious design flaws. For example, the air valve for inflating and deflating the crib is placed on a side of the base thereby making it easy to accidentally open. Fink also uses heat sealed seams to establish the rigidity of the crib. The presence of upper and lower rolled edges on the sidewalls caused by the need to fold material to create these seams is believed to create an unstable frame condition since the legs of the supporting frame must slope or lean inwards to compensate for the difference in size from the bottom of the crib to its top.

Another serious design flaw in Fink's structure lies in the use of straps to hold the sidewalls in an upstanding position should the crib become deflated. It is unlikely that the straps and the associated snap fasteners would hold or remain in position and fastened if pressure were to be placed against one strap which, when it became undone, would cause increasing pressure on adjacent snaps resulting in their becoming undone. Also, the straps will most likely, become undone or unsnapped when the weight of a child creates a downward pressure on the walls of the crib, tending to turn the straps inward and upward in a rotating manner around the frame. This in turn would cause the snap in the sidewalls to be pulled and causes a tearing action which could pull the snap from the crib wall.

Further safety problems may arise with the Fink design if a child were standing in the crib and it deflated. Sagging of the deflated sides could cause gaps between the sides of the crib and the frame. A child within the crib could insert its hand, arm or head through the gaps. If the child then fell or became frightened, it could easily break an arm or be choked to death as the weight of its body pulled against the arm or neck stuck in such a gap.

Accordingly, it is an object of the present invention to provide an inflatable crib which is portable, lightweight, and easy to handle.

It is a further object of the present invention to provide a crib as above which is in compliance with safety requirements.

These and other objects and advantages will become more apparent from the following description and drawings wherein like reference numerals depict like elements.

SUMMARY OF THE INVENTION

In accordance with the present invention, an inflatable crib is formed by an inflatable base portion, a plurality of independently inflatable sidewalls, and a screen-like webbing connecting each sidewall to the base portion. The screen-like webbing permits observation of a child/infant within the crib and the passage of air through the crib. The crib further includes a frame for supporting its inflatable portions and a sleeve attached to each sidewall for receiving a component of the frame.

DETAILED DESCRIPTION

Figure 1:
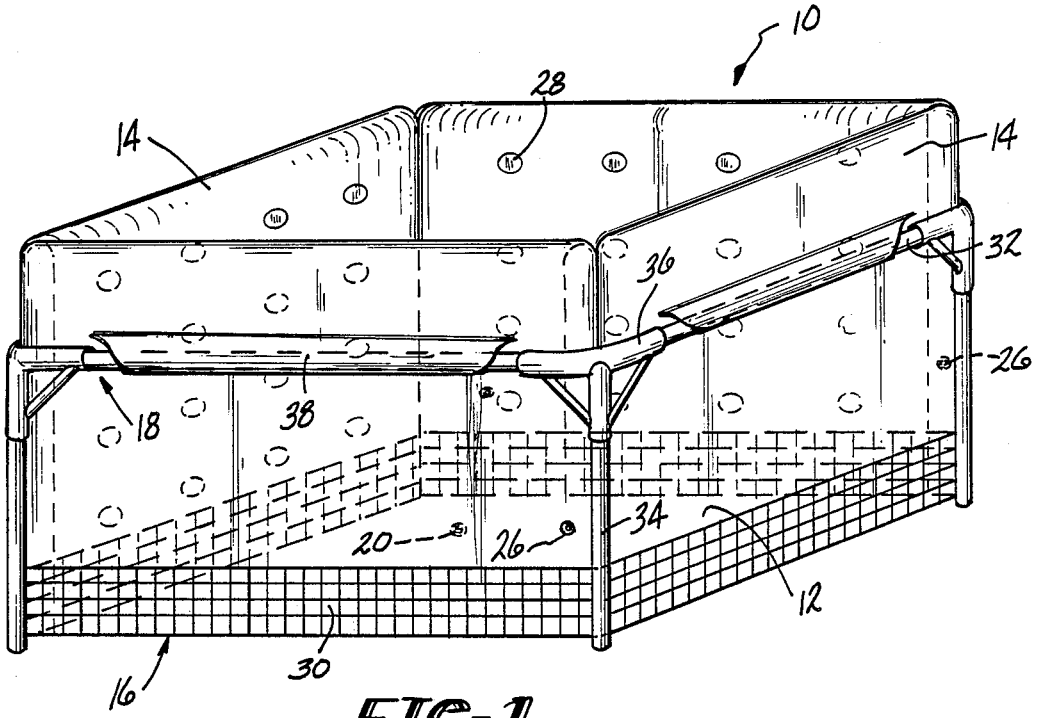
FIG. 1 is a perspective view of an inflatable crib in accordance with the present invention.

Referring now to the drawings, FIG. 1 illustrates an inflatable crib 10 in accordance with the present invention. The crib is suitable for use both as a sleep accommodation for a child/infant and as a playpen. While the crib 10 may have any desired shape, a substantially square configuration is preferred.

The crib 10 differs from other known inflatable crib designs in that it has an inflatable base or floor portion 12 and four independently inflatable sidewall sections 14. By forming the crib with five independently inflatable sections, the deflation of one of the sections does not create a dangerous situation. The crib 10 further differs from other inflatable crib designs in that the sidewalls 14 are not directly connected to the base 12. Instead, a screen-like webbing 16 is used to join the lower edge of each sidewall to the base. The use of the webbing 16 provides certain advantages. First, it facilitates the passage of air through the crib. Second, it allows visual observation of the child/infant within the crib. Finally, it prevents the use of the crib in an unsafe manner such as without the safety support frame 18. If one were to inflate each of the sidewalls and the base, one would still not have a formed crib suitable for use.

The inflatable base portion 12 may be formed from any suitable lightweight plastic material known in the art. Preferably, it is formed from two sheets of plastic material which are electronically welded along all of the edges. By forming the base 12 in this manner, no undesirable folds or rolled edges are present which can interfere with the support frame. A valve 20 is provided for permitting inflation/deflation of the base 12. Preferably, the valve 20 is placed in the sheet that forms the underside of the base during use. Inadvertent opening of the valve and subsequent deflation of the base can be avoided by placing the valve in this position.

The sidewalls 14 are also formed from a suitable lightweight plastic material, preferably the same material used to form the base 12. Hereagain, the sidewalls are formed by electronically welding two sheets of plastic material along all of the edges. In forming the sidewalls 14, however, the two opposed edges 22 which typically form the vertically oriented edges during use are welded so as to form flaps 24. The four sidewalls 14 can then be formed into the desired box-like or square configuration by electronically welding together the flaps of adjoining wall sections. The primary advantage of welding adjoining sections together in this manner is again safety related—namely, the absence of any gaps or openings through which a child/infant can extend a limb or its head. Each sidewall is provided with a valve 26 along the sheet forming the outer surface of the crib during use. Each valve 26 is preferably positioned in a location outside the reach of a child/infant within the crib.

The valves 20 and 26 may be simple mouth inflating tubes having stoppers attached thereto. Alternatively they could be formed by any other suitable form of valve known in the art.

Figure 2:
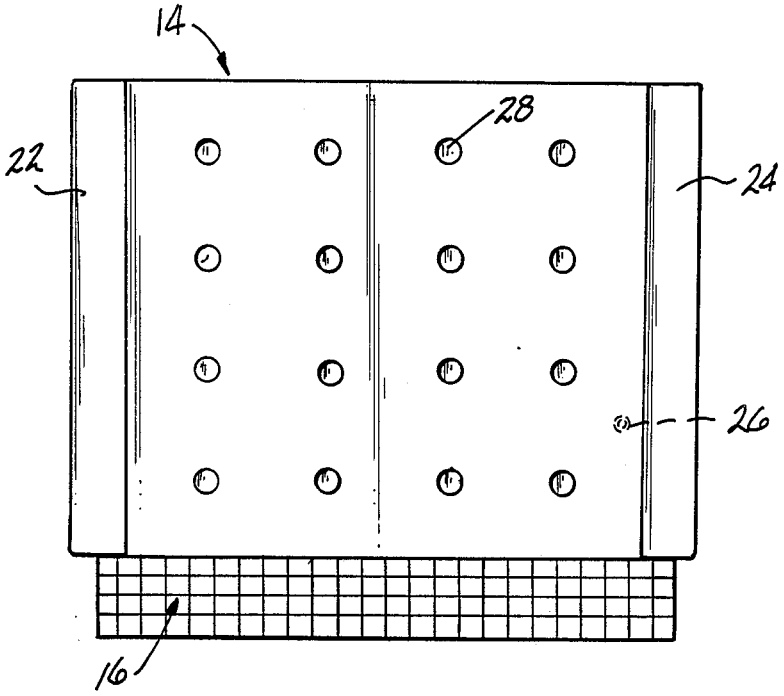
FIG. 2 is a perspective view of a sidewall of the crib.
Figure 3:
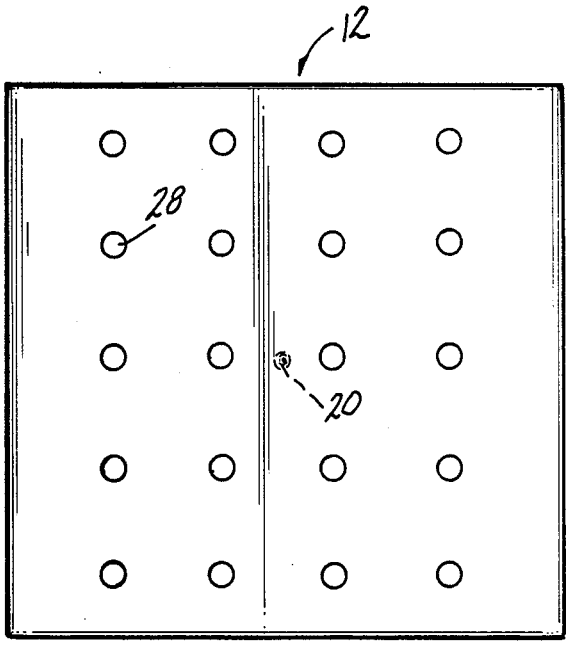
FIG. 3 is a perspective view of the base portion of the crib.

As can be seen from FIGS. 2 and 3, the base 12 and each sidewall 14 are provided with a plurality of button-like members 28. These members are intended to create a cushion-like or quilted pattern to the base and sidewalls. It is believed that such a construction is desirable from the standpoint of preventing a child/infant from wedging itself in a position where it could suffocate.

The webbing 16 joining the sidewalls to the base may also be formed from any suitable lightweight material known in the art. The webbing is preferably joined to the bottom edge of each sidewall and to the edges of the base by electronic welding. Ideally, the webbing is formed from a single piece of material. The openings 30 in the webbing are sized so that a child/infant in the crib could not extend a limb or its head therethrough. When the crib is in an erect position, the webbing extends to a height in the range of from about 10% to about 20% of the total sidewall height.

Figure 5:
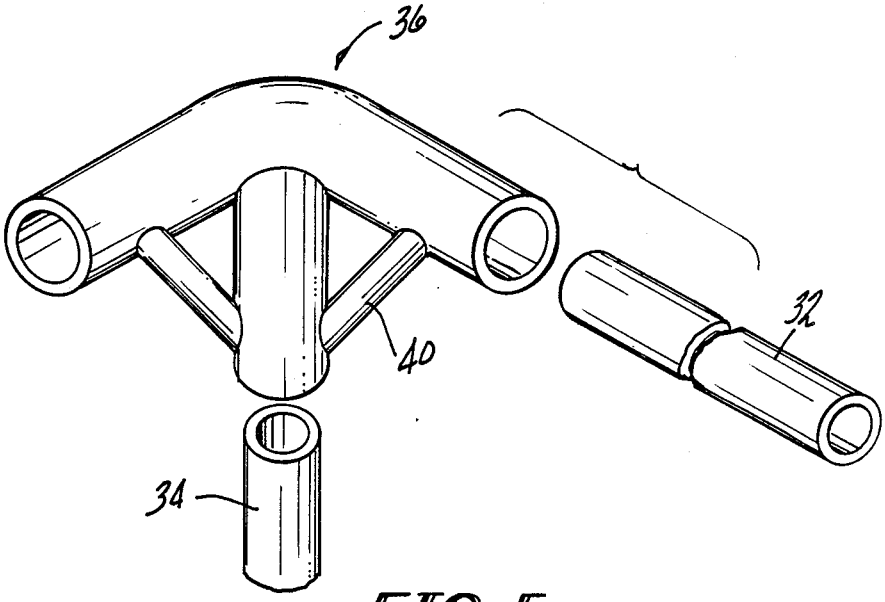
FIG. 5 is a perspective view of the corner brace portion of the frame shown in FIG. 4.
Figure 4:
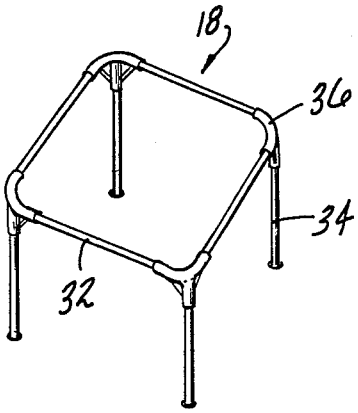
FIG. 4 is a perspective view of the support frame for the crib.

A frame 18 is provided for supporting the inflatable portions of the crib 10. The frame comprises tubular horizontal rod components 32 and legs 34, each preferably formed from a single piece of rigid material. While it is preferred that the legs 34 be formed from a metallic material, the frame components 32 may be formed from either a rigid plastic material or a suitable metal or metal alloy. As shown in FIG. 5, the horizontal components and the legs are joined at each corner by a corner brace 36. The corner brace 36 may be formed either by a plastic or metallic material. Ideally, the brace 36 receives the leg 34 at an angle relative to the vertical axis of the sidewall. It is believed that providing a supporting frame with an outwardly angled leg provides stability against the possibility of the crib leaning due to a child/infant leaning against one side of the crib.

The support frame 18 is joined to the sidewalls of the crib by sleeves 38 adapted to receive the horizontal components of the frame. The sleeves 38 may be affixed to the sidewalls 14 in any desired manner. For example, the sleeves 38 may be welded to the sidewalls. Ideally, the sleeves are located below the top edge of the sidewall by about 20% ro about 25% of the total sidewall height. By positioning the sleeves 38 in this location, well below the top edge of the sidewalls, no gaps or openings are created between the support frame 18 and the sidewalls through which a child/infant could insert a limb or its head.

Generally, the base portion 12 of the crib rests on the floor when the crib 10 is supported by the frame 18; however, if desired, a frame could be provided that suspends the crib so that the base 12 is spaced from the floor.

As can be seen from the foregoing description, the design of the inflatable crib 10 of the present invention is highly safe. First, there are no openings through which a child/infant could extend a limb or insert its head. Second, a safety frame is provided for supporting the inflatable portions of the crib. Third, deflation of a single inflatable section does not render the crib unsafe. Fourth, provision is made for adequate air flow through the crib. Finally, a child/infant within the crib can be observed.

Further advantages of the present invention are that the crib is formed from lightweight components and can be easily assembled and disassembled. As a result, cribs in accordance with the present invention are easily transportable. Further, the crib in its collapsed condition is extremely compact and can be stored in a relatively small area.

It is apparent that there has been provided in accordance with this invention an inflatable crib which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An inflatable crib for accommodating a child/infant which comprises:

an enclosure defined by an inflatable base portion, a plurality of inflatable sidewalls, and pieces of webbing connecting said inflatable sidewalls to said base portion;

said webbing permitting observation of said child/infant being accommodated within said crib and allowing air to pass through said crib;

all of said sidewalls and said base portion being independently inflatable; and each piece of webbing being substantially coextensive with a respective one of said sidewalls which it connects to said base portion, such that a substantially continuous band of webbing extends about the bottom of the enclosure.

2. A crib according to claim 1 which further comprises an air valve for inflating and deflating said base portion, said air valve being located on the bottom of said base portion when said crib is inflated.

3. A crib according to claim 1 which further comprises an air valve associated with each said sidewall to permit independent inflation of each said sidewall.

4. A crib according to claim 1 wherein said sidewalls each have flaps adjacent respective end portions and adjoining ones of said sidewalls being joined together by electronically welding adjacent flaps to form a box-like configuration.

5. A crib according to claim 1 which further comprises:

a frame for supporting said crib; and said frame having a plurality of rigid one-piece legs and a plurality of horizontal components.

6. A crib according to claim 5 wherein each said sidewall has a sleeve attached thereto for receiving one of said horizontal frame components.

7. A crib according to claim 6 which further comprises a brace adjacent each corner of the frame for connecting one of said legs to two adjacent ones of said horizontal components, and whereby said brace positions said one leg at an angle relative to said sidewalls to provide stability against leaning of the crib when said child/infant leans against one of said crib sidewalls.

8. A crib according to claim 1 wherein said sidewalls are of an equal size.

9. A crib according to claim 1 wherein said base portion and each of said sidewalls are each formed by two sections of plastic material electronically welded together without any folds.

10. A crib according to claim 1 wherein each said connecting piece of webbing is welded to said one respective sidewall and to said inflatable base portion.

* * * * *